US010900494B2

(12) United States Patent
Holder

(10) Patent No.: US 10,900,494 B2
(45) Date of Patent: Jan. 26, 2021

(54) ADAPTABLE SPORT COVER FOR INTERIOR AND EXTERIOR FEATURES

(71) Applicant: Donn R. Holder, Jacksonville, FL (US)

(72) Inventor: Donn R. Holder, Jacksonville, FL (US)

( * ) Notice: Subject to any disclaimer, the term of this patent is extended or adjusted under 35 U.S.C. 154(b) by 0 days.

(21) Appl. No.: 16/712,910

(22) Filed: Dec. 12, 2019

(65) Prior Publication Data

US 2020/0208643 A1 Jul. 2, 2020

Related U.S. Application Data

(60) Provisional application No. 62/787,655, filed on Jan. 2, 2019.

(51) Int. Cl.
*F04D 29/00* (2006.01)
*F21V 33/00* (2006.01)
*F04D 25/08* (2006.01)

(52) U.S. Cl.
CPC ..... *F04D 29/005* (2013.01); *F04D 25/088* (2013.01); *F21V 33/0096* (2013.01)

(58) Field of Classification Search
None
See application file for complete search history.

(56) References Cited

U.S. PATENT DOCUMENTS 2,418,590 A * 4/1947 Linzell ..... C01F 11/466 423/172
5,549,940 A * 8/1996 Noone ..... B44C 5/00 206/579
6,093,983 A * 7/2000 Singh ..... H01R 33/46 307/125
8,827,497 B1 * 9/2014 Newman ..... F21V 33/0096 362/277
2008/0248714 A1 * 10/2008 Zacharias ..... F04D 25/088 446/228
2008/0310959 A1 * 12/2008 Johnson ..... F04D 25/088 416/5
2009/0041581 A1 * 2/2009 Foxworth ..... F04D 29/005 416/62
2012/0057361 A1 * 3/2012 Corliss ..... B60Q 1/2661 362/485
2012/0274767 A1 * 11/2012 Hornback ..... H04R 1/025 348/143
2014/0205479 A1 * 7/2014 Wark ..... F04D 29/601 417/411

OTHER PUBLICATIONS https://www.lowes.com/pd/Hunter-Baseball-44-in-Leather-Look-Downrod-Mount-Indoor-Ceiling-Fan-with-Light-Kit-4-Blade/1102335 (Year: 2011).*

* cited by examiner

*Primary Examiner* — Britt D Hanley
(74) *Attorney, Agent, or Firm* — Camille A. Wilson; Wilson Dutra, PLLC

(57) ABSTRACT

What is needed is a system that a system that may allow a consumer to adapt a light source to customize a room. Accordingly, the present disclosure relates to a system that may be adapted to a range of features, wherein the system may convey a preference for a sport, sports team, college, or other source of fandom. In some embodiments, a sport cover may be integrated with a feature, such as a fan, wall mount, chandelier, or lamp. In some aspects, the sport cover may comprise a range of customizable attributes, such as colors, sounds, images, and sport cover types. According to the present disclosure, a consumer may change out the light fixture on the fan to with an adaptable or convertible sports cover.

20 Claims, 10 Drawing Sheets

FIG. 12A
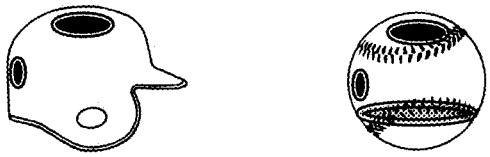
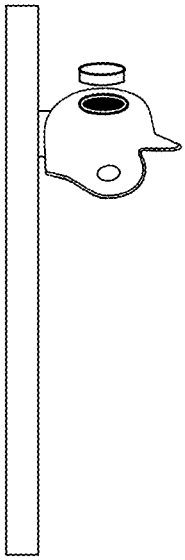
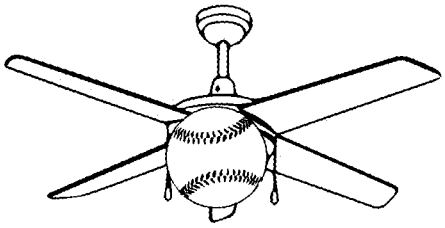
FIG. 12B
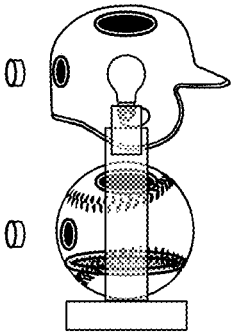
FIG. 12C
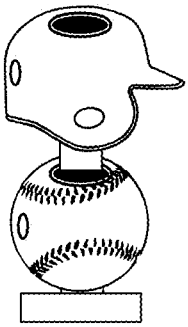
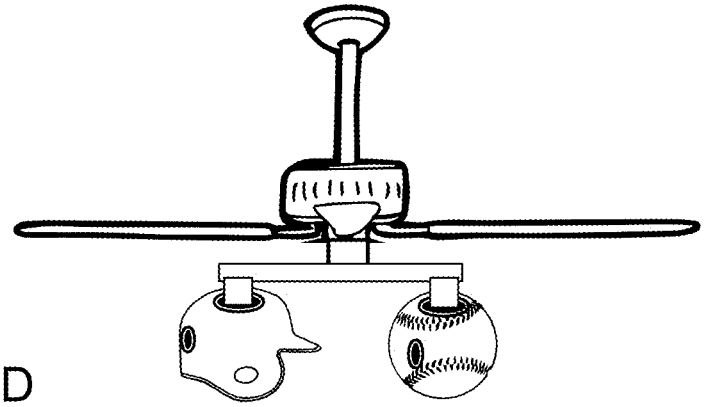
FIG. 12D

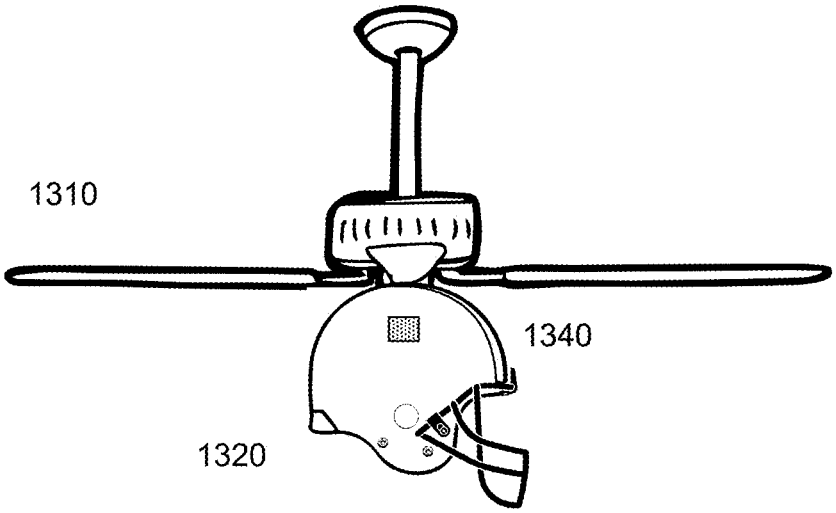
FIG. 13
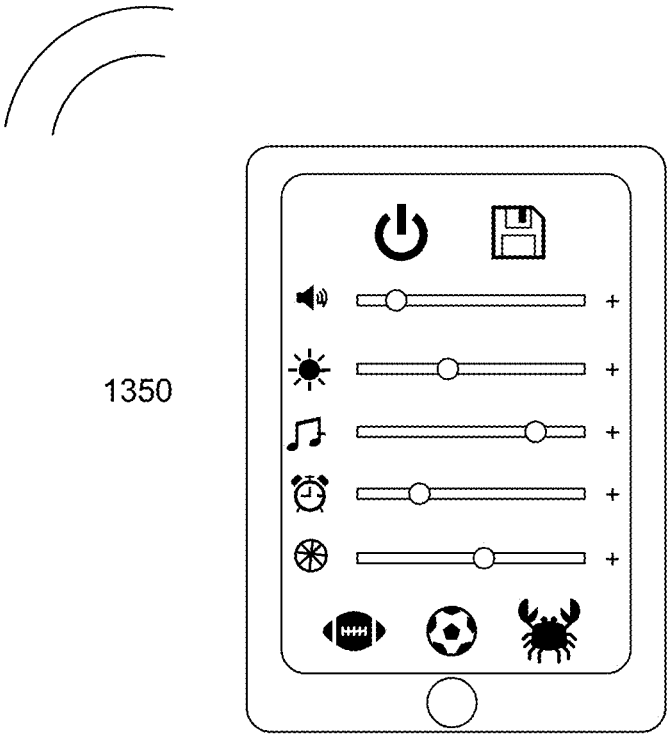

ADAPTABLE SPORT COVER FOR INTERIOR AND EXTERIOR FEATURES

CROSS-REFERENCE TO RELATED APPLICATION

This application claims priority to and the full benefit of U.S. Provisional Patent Application Ser. No. 62/787,655, filed Jan. 2, 2019, and titled "ADAPTABLE SPORT COVER FOR INTERIOR AND EXTERIOR FEATURES", the entire contents of which are incorporated in this application by reference.

BACKGROUND

Before Thomas Edison effectively commercialized the incandescent lightbulb, British inventors were experimenting with the arc lamp. A carbon arc light, which used carbon electrodes in the air, was considered one of the first versions of an electric light. The carbon arc light was used for street and building lighting in the nineteenth century before incandescent light became more prevalent.

While trying to produce a mass commercialized model, scientists worked on improving an incandescent lightbulb's filament and the bulb's atmosphere. The filament was the part of the lightbulb that produced light when heated by an electrical current, while the bulb's atmosphere required air being vacuumed out of a bulb or filled with an inert gas to ensure that the filament did not oxidize and burn out. As part of this experimentation process, many early bulbs had incredibly short lifespans, were expensive to produce, or used too much energy. Innovations in creating an effective incandescent material, a higher vacuum, and a high resistance that balanced power distribution facilitated the commercialization of the incandescent lightbulb in the late nineteenth century.

Since the commercialization of the incandescent lightbulb, there have been continuous innovations centering around the lightbulb. For example, ceiling fans incorporated lightbulbs to provide both air flow and light. According to a 2007 study, an average American household uses about 45 light bulbs per year, and this can come from a variety of appliances and household décor, such as ceiling fans, bedside lamps, and light fixtures. On average, there are about 67 lamps or light sources per American home.

One of the common sources of light in a home is the ceiling fan. Last year the ceiling fan market reached 385 million US dollars and is projected to reach 445 million by 2021. Due to the expansive size of the market, several companies produce their own unique variations revolving around the ceiling fan. Each solution requires unique products within a company's specifications or within a product line's parameters, meaning consumers are not able to adapt or customize their purchases. For example, a consumer may not be able to switch out the blades in their ceiling fans or customize the light source with other company's products or offerings.

SUMMARY OF THE DISCLOSURE

What is needed is a system that may allow a consumer to adapt a light source to customize a room. Accordingly, the present disclosure relates to a system that may be adapted to a range of features, wherein the system may convey a preference for a sport, sports team, college, or other source of fandom. In some embodiments, a sport cover may be integrated with a feature, such as a fan, wall mount, chandelier, or lamp. In some aspects, the sport cover may comprise a range of customizable attributes, such as colors, sounds, images, and sport cover types. According to the present disclosure, a consumer may change out the light fixture on the fan to with an adaptable or convertible sports cover.

The present disclosure relates to an adaptable sport cover comprising a sport equipment shell related to a first sport; an opening to receive a portion of a feature; and an adapter, wherein the adapter connects the sport equipment shell to the feature. In some aspects, the sport equipment shell may comprise a helmet. In some embodiments, the adaptable sport cover may further comprise a sound source that outputs audio related to the first sport.

In some implementations, the portion of the feature may comprise a light source. In some embodiments, the adapter may fit into an electrical connection of the feature. In some aspects, the adapter may allow for remote control of the light source. In some embodiments, the sport equipment shell may comprise a light-changing filter, where the light-changing filter may affect a light type associated with the light source. In some aspects, the light-changing filter may be passive. In some implementations, the light-changing filter may be active.

In some embodiments, the adapter may be located at the opening. In some aspects, the adapter may comprise a spring mechanism. In some implementations, the adapter is adjustable based on a size of the portion of the feature.

The present disclosure relates to an adaptable sport cover and feature system comprising: a feature comprising a light source; a sport cover comprising: a sport equipment shell related to a first sport; and an opening to accept the light source. In some aspects, the feature may comprise a lamp. In some implementations, the sport cover may comprise a helmet.

In some embodiments, the sport cover may further comprise a sound source. In some aspects, control of one or more of the feature, the light source, and the sound source may be remote. In some implementations, the feature comprises a ceiling fan. In some embodiments, the sport cover may further comprise a plurality of sport fan blades, and wherein the sport fan blades relate to the first sport. In some aspects, the first sport may comprise baseball and the plurality of sport fan blades comprise a baseball bat design.

BRIEF DESCRIPTION OF THE DRAWINGS

The accompanying drawings that are incorporated in and constitute a part of this specification illustrate several embodiments of the disclosure and, together with the description, serve to explain the principles of the disclosure:

FIG. 12A illustrates an exemplary pair of sport covers, according to some embodiments of the present disclosure.

FIG. 12B illustrates features with an exemplary pair of sport covers, according to some embodiments of the present disclosure.

FIG. 12C illustrates an exemplary feature with a pair of sport covers, according to some embodiments of the present disclosure.

FIG. 12D illustrates a fan with an exemplary pair of sport covers, according to some embodiments of the present disclosure.

FIG. 13 illustrates a fan with an exemplary sport cover and remote, according to some embodiments of the present disclosure.

DETAILED DESCRIPTION

The present disclosure provides generally for a device or adapter to enhance a residential or commercial feature. According to the present disclosure, a sport cover may be paired with standard features, which may allow for customization and an expression of enthusiasm for a sport or team. In some aspects, a sport cover may be adaptable to a range of feature types, wherein the sport cover may be removable and attachable to a predefined set of feature types, such as fans and lamps.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Sport Cover: as used herein refers to a device configured to attach to interior and exterior features, such as lamps, fans, or lighting, as non-limiting examples. In some aspects, the sport cover may resemble equipment or uniform components related to sports, such as helmets, balls, clubs, bats, or sticks, as non-limiting examples.

Light Source: as used herein refers to any type of mechanism that may provide light. In some aspects, a light source may attach to an exterior or interior feature, such as a fan, a lamp, or chandelier, as non-limiting examples. In some embodiments, a light source may comprise one or more bulbs, strips, projections, panels, or strings, as non-limiting examples.

Light Type: as used herein refers to the light emitted from a light source. In some aspects, light types may comprise colors, brightness, images, patterns, duration, or flicker patterns, as non-limiting examples.

Feature: as used herein refers to a fixture or free-standing accessory for the home or office, wherein the fixture or accessory may comprise or may be attachable to a light source. As non-limiting examples, a feature may comprise a fan, lamp, or chandelier.

The present disclosure relates to a sports cover adapter or converter that may integrate various different design elements and functionality that may universally fit onto different ceiling fans. More specifically, the sports cover may utilize a series of springs and other connections to be able to universally fit different ceiling fans from different manufacturers.

Figure 1A:
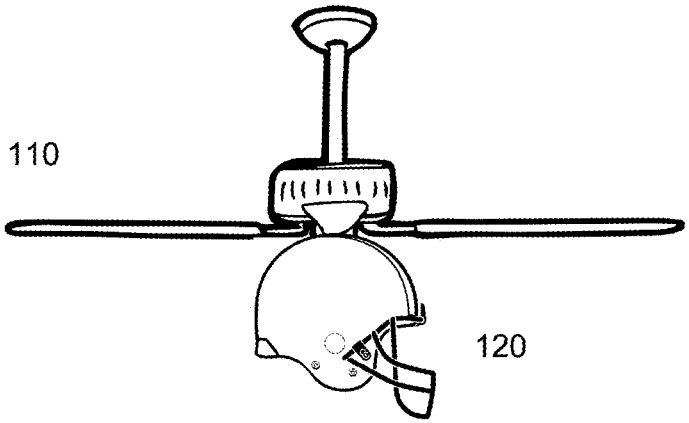
FIG. 1A illustrates a fan with an exemplary sport cover, according to some embodiments of the present disclosure.

Referring now to FIG. 1A, a fan 110 with exemplary sport cover 120 is illustrated. In some embodiments, the sport cover 120 may comprise an adapter that may be placed in the center of the sport cover 120, but not limited to one specific spot on the sport cover 120. In some aspects, the sport cover 120 may comprise one or more materials, wherein the materials may depend on a range of factors, such as preferences, weight restrictions of the feature, light types, and customizable attributes, as non-limiting examples. In some implementations, the sport cover 120 may comprise material typically associated with the sports equipment it represents. In some embodiments, a sport cover may comprise a converter. In some implementations, a converter may integrate with a light source or other connected feature, such as a ceiling fan.

Figure 1B:
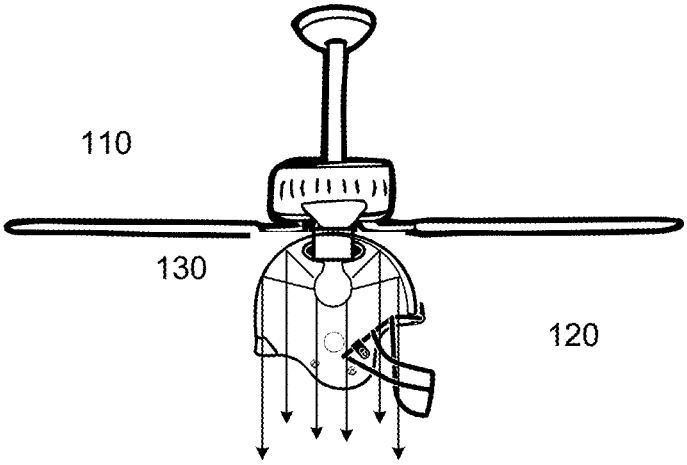
FIG. 1B illustrates an open view of a fan with an exemplary sport cover, according to some embodiments of the present disclosure.

Referring now to FIG. 1B, an open view of a fan 110 with exemplary sport cover 120 is illustrated. In some aspects, the sport cover 120 may comprise materials suitable for combining with features, such as metals, plastics, glass, or combinations thereof, as non-limiting examples. In some embodiments, the interior of a sport cover 120 may comprise a reflective surface that may direct light out of the sport cover 120. In some aspects, one or both the adapter and sport cover 120 may be adjustable to fit a range of features, such as varying sizes, configurations, materials, and surrounding conditions, as non-limiting examples.

In some aspects, the sport cover 120 may be combined with an adapter, wherein the sport cover 120 may comprise an opening to receive the adapter. In some embodiments, the sport cover 120 may comprise a fastener that may secure one or both the adapter or the feature to the sport cover 120, which may limit shifting. In some implementations, the sport cover 120 may comprise a light source 130 that may be adapted to use the electricity from the feature. In some aspects, the feature may comprise a light source 130, wherein the sport cover 120 may be placed over the light source 130. In some aspects, the fastener may comprise a spring adjuster, which may allow the sport cover 120 to snap onto the fan 110.

In some embodiments, the sport cover 120 may comprise inserts with chains attached to them, which may allow for manual operation of one or both the sport cover 120, the fan 110, and the light source 130. In some aspects, the chain may be customizable, such as to complement the sport cover 120. In some implementations, the sport cover 120 may be fitted over chains attached to one or both the light source 130 and the fan 110.

Figure 1C:
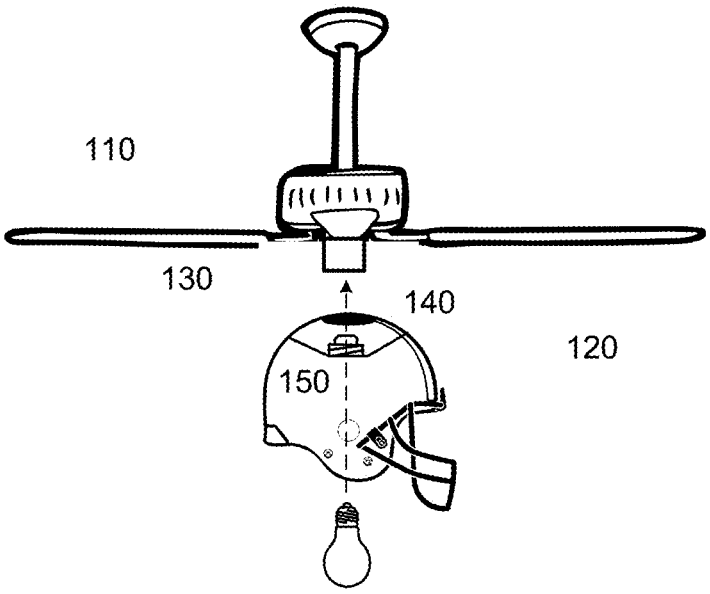
FIG. 1C illustrates an open view disassembled view of a fan with an exemplary sport cover, according to some embodiments of the present disclosure.

Referring now to FIG. 1C, a deconstructed view of a fan 110 with exemplary sport cover 120 is illustrated. In some aspects, a sport cover may comprise an opening 140 that may allow the sport cover 120 to fit onto a fan 110, or other features. In some embodiments, the sport cover 120 may comprise an adapter 150 that may connect the sport cover 120 to the fan 110. In some implementations, the adapter 150 may fit into an electrical connection in the fan 110, such as the light socket or power source. In some aspects, a light source 130 may fit into the adapter 150. In some implementations, the sport cover 120 may comprise a light source 130, and the adapter 150 may connect the light source 130 to the fan 110. In some embodiments, the adapter 150 may allow for remote control of one or more electrical component of the fan 110, such as the light source, a sound source, or a fan speed, as non-limiting examples.

Figure 1D:
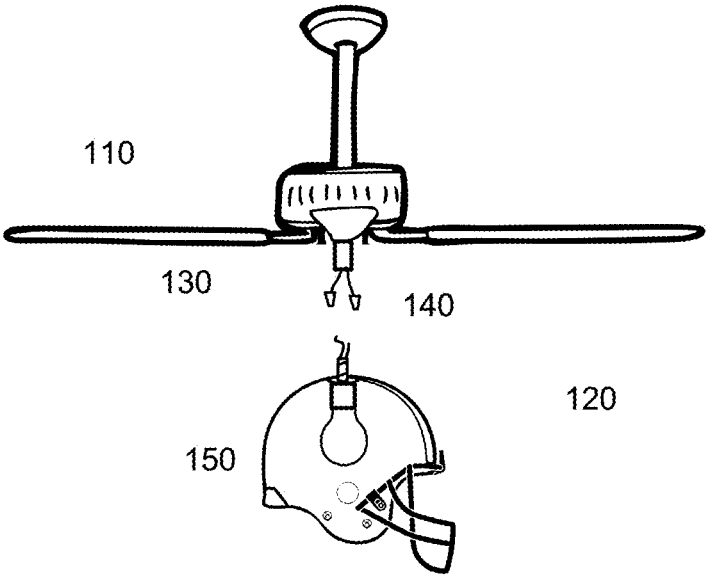
FIG. 1D illustrates an open view disassembled view of a fan with an exemplary sport cover, according to some embodiments of the present disclosure.

Referring now to FIG. 1D, a deconstructed view of a fan 110 with exemplary sport cover 120 is illustrated. In some embodiments, the sport cover 120 may comprise a permanent light source 130, wherein the electrical components may be attached to the sport cover 120. In some implementations, a sport cover 120 may comprise an adapter 150 that may extend the light source 130 wiring to attach to the available wiring of the fan 110. In some aspects, a sport cover may comprise an opening 140 through which the available wiring of the fan 110 may fit into. The exterior of the adapter 150 may comprise a threaded surface that may fit into a wiring housing 160 of the fan.

Figure 2A:
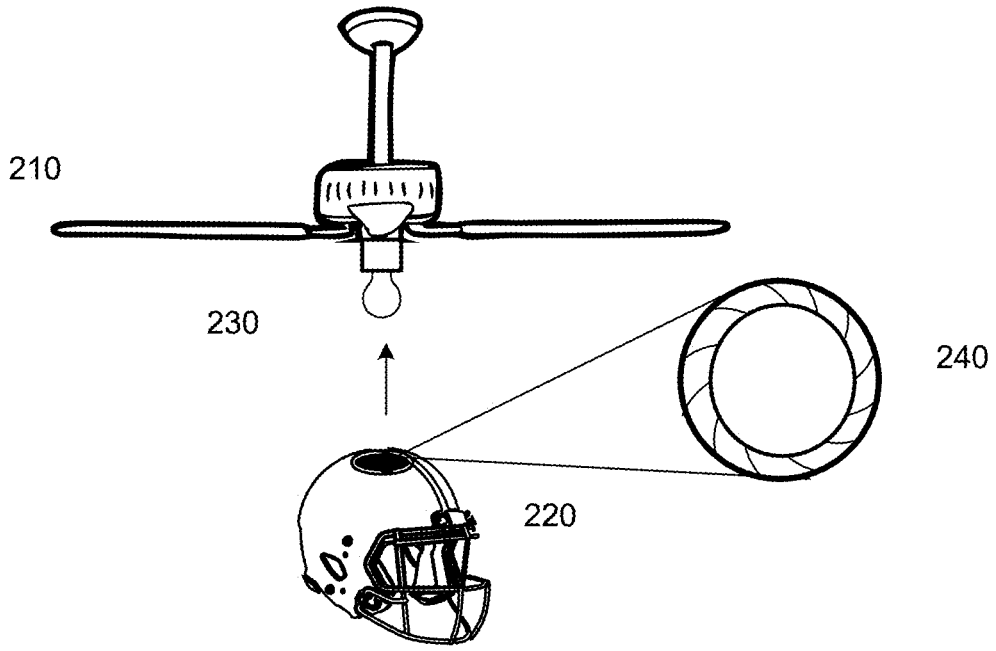
FIG. 2A illustrates an exemplary sport cover to fit a fan with a light source, according to some embodiments of the present disclosure.

Referring now to FIG. 2A, an exemplary sport cover 220 to fit a fan 210 with a light source 230 is illustrated. In some embodiments, an adapter 240 may fix a sport cover 220 to a fan 210, wherein the inside of the adapter 240 may comprise spring-like adjustment pieces that may allow for easy and quick attachment and detachment of a sport cover 220. In some implementations, the spring-like adjustment pieces may be adjusted, such as tightening and loosening the springs based on the size of the fan.

In some embodiments, the adapter 240 may be set to a fixed width until placed on the fan 210. In some aspects, the adapter 240 may be adjusted to the fan 210 or feature, such as based on size or manufacturer of the fan. In some embodiments, a sport cover 220 may comprise an opening with an adapter 240 that may attach the sport cover 220 to the fan 210. The adapter 240 may be used to detach the sport cover 220 from the fan 210. In some aspects, an adapter 240 may be used to connect the electrical components from the sport cover 220 to the fan 210, such as illustrated in FIG. 1C.

In some embodiments an adapter 240 may be universal allowing the sport cover 220 to fit over a range of features. In some aspects, where the adapter 240 fits onto the opening of the sport cover, the limitations of fitting with a feature may be based on the size and shape of the opening. In some aspects, the adapter 240 may be customized to specific manufacturers or feature types.

Figure 2B:
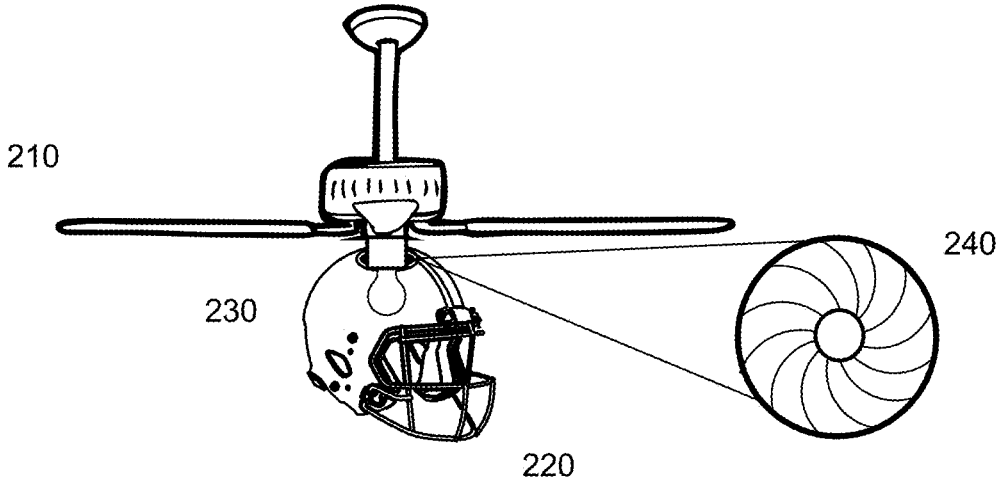
FIG. 2B illustrates a fan with a transparent view of an exemplary sport cover, according to some embodiments of the present disclosure.

Referring now to FIG. 2B, a fan 210 with a transparent view of an exemplary sport cover 220 is illustrated, wherein the sport cover 200 may comprise an adapter 240 at the opening that receives the fan 210. In some aspects, the sport cover 220 may be removable, wherein the sport cover 220 may be replaced by another variation or with the original light fixture from the fan 210. In some embodiments, the sport cover 220 may be integrated with the fan 210 during manufacturing. In some implementations, the sport cover 220 may be a post-manufacture addition, wherein the sport cover 220 may be adapted to a range of features.

Figure 3:
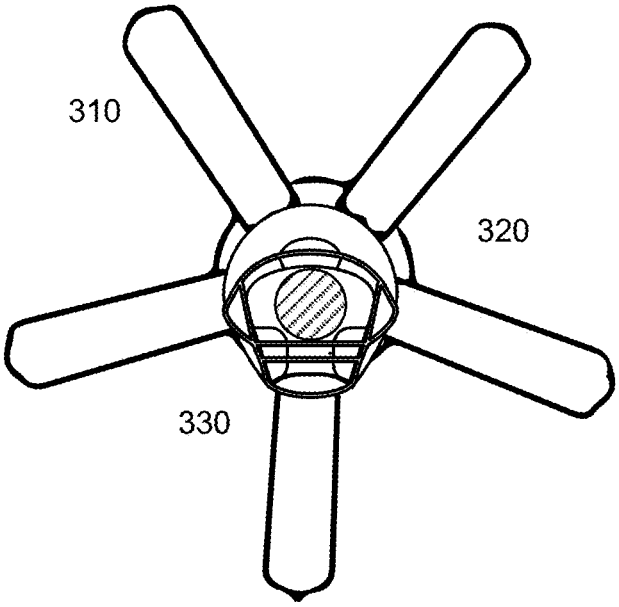
FIG. 3 illustrates a fan with an exemplary sport cover, according to some embodiments of the present disclosure.

Referring now to FIG. 3, a fan 310 with an exemplary sport cover 320 is illustrated. In some aspects, the sport cover 320 may cover a single light source 330, such as a bulb. In some embodiments, the light source 330 may be connected to the fan 310, during manufacture or post manufacture, such as by a user installing the light source 330. In some implementations, the color of the light source 330 may be adjustable, such as by a chain attached to the fan 310, a dimmer, a remote, a paired smartphone, an online application, or other control mechanisms, as non-limiting examples.

Figure 4:
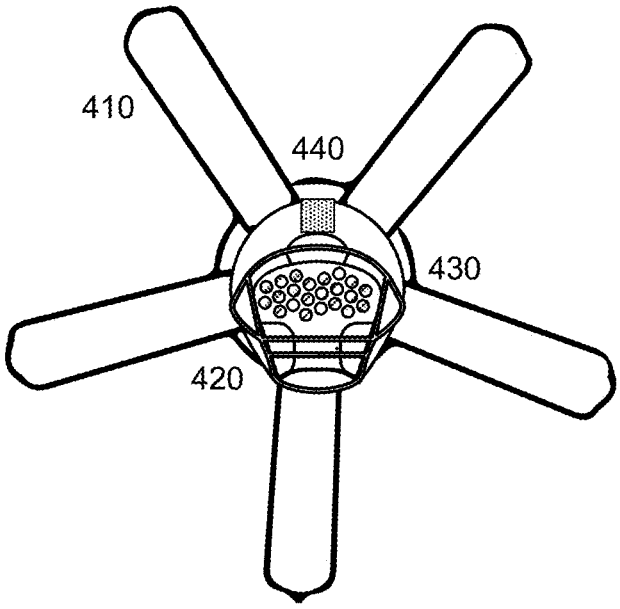
FIG. 4 illustrates a fan with an exemplary sport cover, according to some embodiments of the present disclosure.

Referring now to FIG. 4, a fan 410 with an exemplary sport cover 420 is illustrated. In some implementations, the sport cover 420 may cover a broad light source 430 comprising multiple lights, such as a string, a strip, or a pad, as non-limiting examples. In some embodiments, the light source 430 may be able to display a range of colors, wherein the colors may be customizable, such as to match team colors, country colors, or general preferences, as non-limiting examples. In some aspects, the light source 430 may be able to display images, such as team name, sports equipment, team mascots, or team symbol, as non-limiting examples. The images may be projected or may be formed by controlling the active portion of the light source 430.

In some embodiments, a sound source 440 may be installed with the sport cover 420, wherein the sound source 440 may be configured to play one or more sounds, music, or dialogue, as non-limiting examples. In some aspects, the sounds may be preprogrammed to play a predefined set of options that may be operated through a remote, wall switch, pull chain, or other paired device. In some implementations, sounds may be played periodically, when a predefined event occurs, on demand, or combination of those controls. For example, the sound source 440 may play a fight song when someone claps three times. In some embodiments, a paired device may play media through the sound source 440, such as through Bluetooth or streaming.

In some aspects, the sound source 440 may comprise a music box or a speaker. In some embodiments, the sound source 440 may be battery operated, may be rechargeable, or may integrated with the electrical system of the feature. In some implementations, where the feature may be easily accessible, the sound source 440 may be removable and rechargeable, such as a portable music device or a smartphone.

Figure 5B:
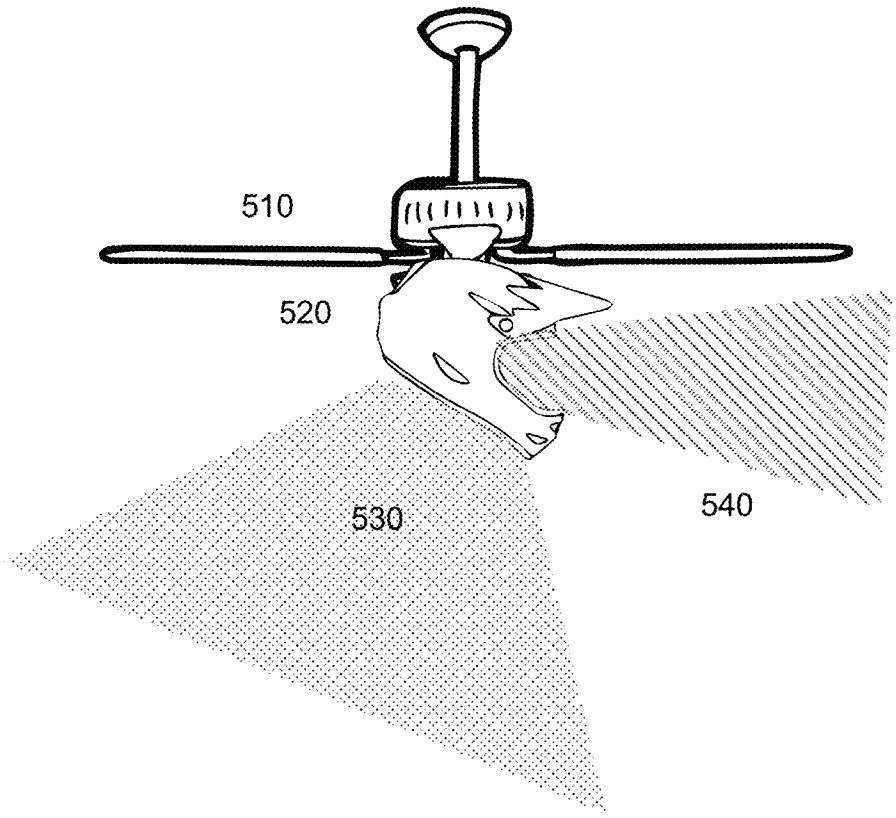
FIG. 5B illustrates a fan with an exemplary sport cover with an open face shield, according to some embodiments of the present disclosure.
Figure 5A:
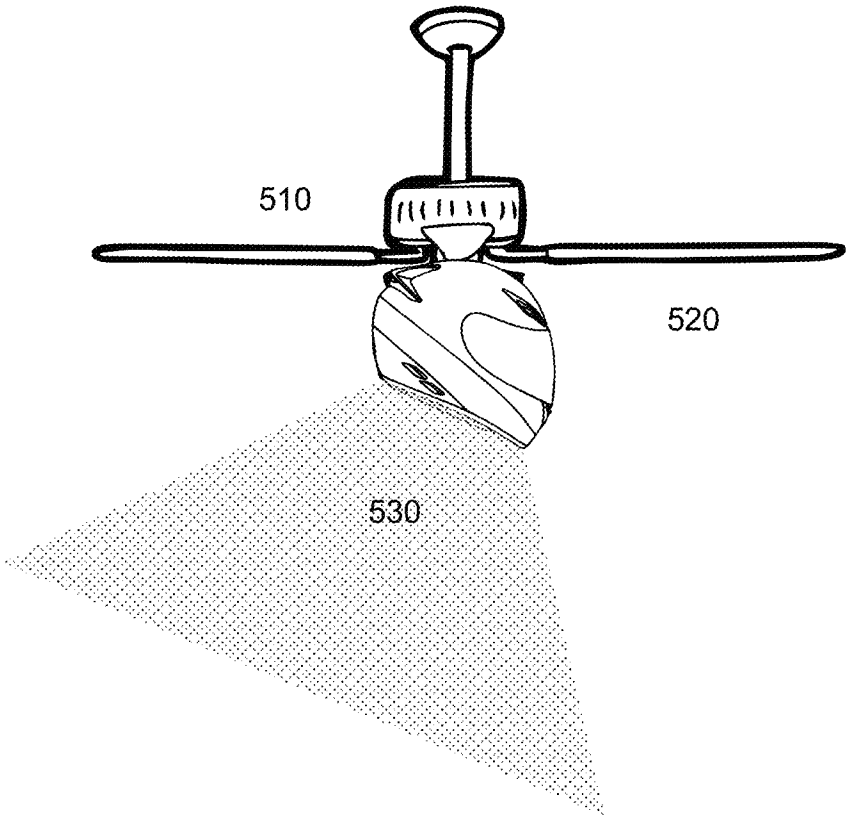
FIG. 5A illustrates a fan with an exemplary sport cover with a closed face shield, according to some embodiments of the present disclosure.

Referring now to FIG. 5A, a fan 510 with an exemplary sport cover 520 with a closed face shield is illustrated. In some embodiments, a first light type 530 may shine through the base of the sport cover 520. In some aspects, the face shield may limit escape of lateral light. In some implementations, the face shield may comprise a partially transparent material, wherein light may emanate through the face shield. In some embodiments, the face shield may be tinted, wherein the emanating light may comprise a color.

In some embodiments, the face shield may comprise a filter that may affect the output of the light source. In some aspects, the tint of the face shield may be customizable. For example, the selected face shield color may be attached prior to installation. As another example, the shield cover may cycle through a predefined set of colors, such as through layering of shield covers. Three stackable shield covers may be remotely controlled, wherein each of the stackable shield covers may comprise different colors, wherein combinations may allow for different tints. This may allow for a user to customize the color after installation. In some aspects, the face shield may comprise a cutout, wherein light that shines through the face shield will form an image on a nearby surface. In some embodiments, the face shield may comprise a display screen that may be preprogrammed or programmable, which may allow for a dynamic projection.

Referring now to FIG. 5B, a fan 510 with an exemplary sport cover 520 with an open face shield is illustrated. In some embodiments, a first light type 530 may shine through the base of the sport cover 520, and a second light type 540 may shine through the face shield opening. In some aspects, one or both the first light type 530 and the second light type 540 may be customizable, such as through colors, visual patterns, flashing patterns, or combinations thereof, as non-limiting examples.

In other aspects the sport cover 520 may be made up of some transparent material allowing minimal light to slip through the surface of the sport cover. In other aspects the user may also control the transparency of their material when manufactured allowing for a custom lighting for each individual based on personal preference.

Figure 6:
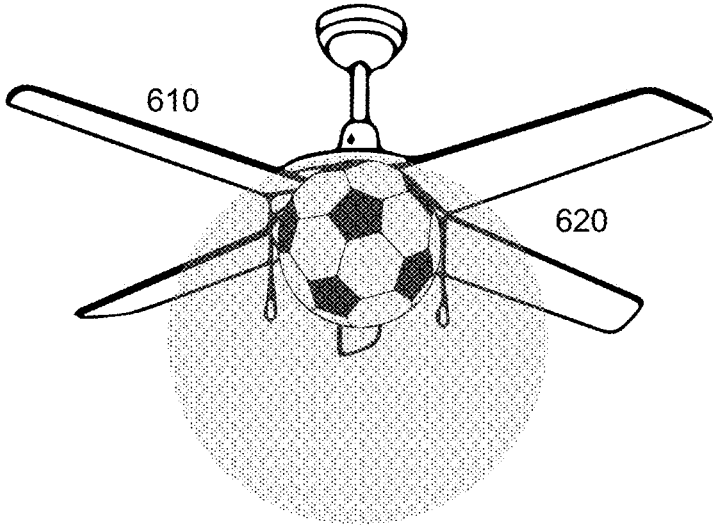
FIG. 6 illustrates a fan with an exemplary sport cover, according to some embodiments of the present disclosure.

Referring now to FIG. 6, a fan 610 with an exemplary sport cover 620 is illustrated. In some aspects, the sport cover 620 may comprise a soccer ball with partially opaque panels, wherein light may glow from an internal light source. In some embodiments, the opaque panels may comprise different colors, which may allow for multicolored lighting. In some aspects, the sport cover 620 may rotate, which may be remotely controlled or controlled directly through a cord on the fan 610. In some embodiments, other sports covers may have partially opaque panels.

Figure 7:
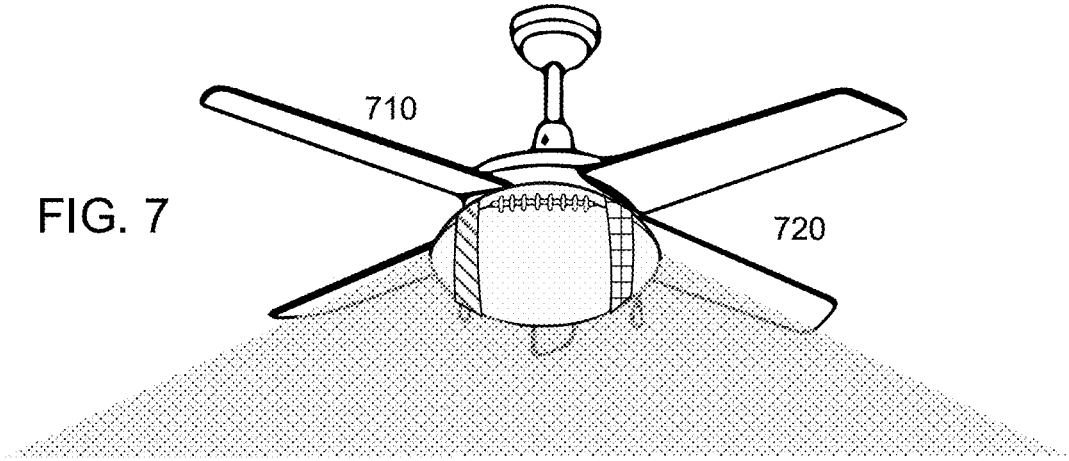
FIG. 7 illustrates a fan with an exemplary sport cover, according to some embodiments of the present disclosure.

Referring now to FIG. 7, a fan 710 with an exemplary sport cover 720 is illustrated. In some implementations, the sport cover 720 may comprise a football with independently lit side stripes. In some aspects, the side strips may comprise LEDs with customizable colors. In some embodiments, the side strips may be remotely controlled, such as through a wall dimmer, remote controller, or smartphone, as non-limiting examples.

Figure 8:
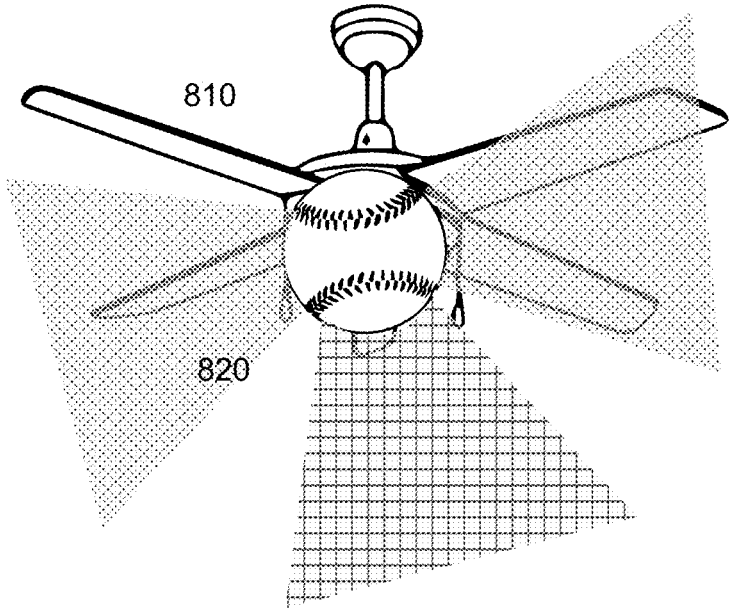
FIG. 8 illustrates a fan with an exemplary sport cover, according to some embodiments of the present disclosure.

Referring now to FIG. 8, a fan 810 with an exemplary sport cover 820 is illustrated. In some embodiments, the sport cover 820 may comprise a baseball with distinct color panels, which may allow for two light types. In some aspects, the "stitching" of the sport cover 820 may comprise a separate light source or color. In some implementations, the color panels may be adjusted, such as by changing a color of the light source, the color of the panels, or combinations thereof.

Figure 9A:
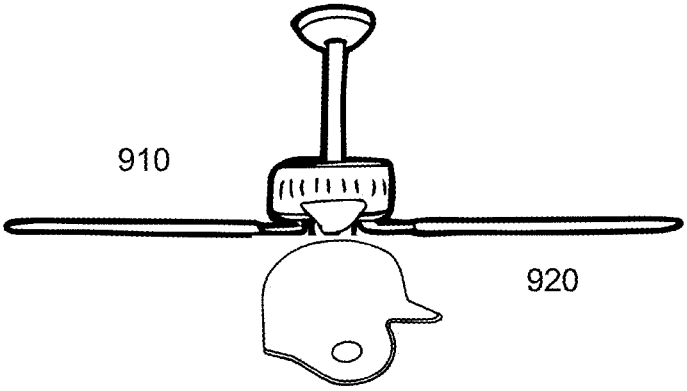
FIG. 9A illustrates a side view of a fan with an exemplary sport cover, according to some embodiments of the present disclosure.

Referring now to FIG. 9A, a side view of a fan 910 with an exemplary sport cover 920 is illustrated. In some aspects, the sport cover 920 may comprise a baseball helmet. In some embodiments, a pull chain may be customized to match the theme of the sport cover 920, such as a team symbol, a team color, a team mascot, a sport-related image, a sport-related phrase, or combinations thereof.

In some aspects the mask of the sport cover 920 may come as a cage as shown or a fully enclosed material the resembles; the fully enclosed material may allow the user to to have a more steady light throughout the room rather than the spotted look of light that the cage may provide. The sport cover 920 may also come with a removable cage that may allow the user to have a muvh brighter feel of the light.

Figure 9B:
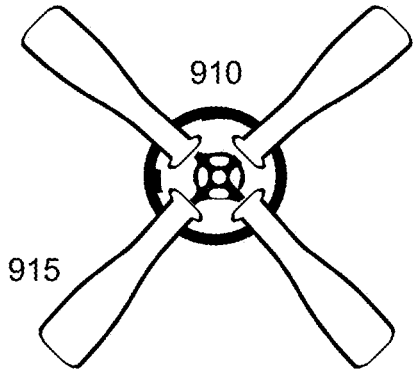
FIG. 9B illustrates a bottom up view of a fan with exemplary sport accessories, according to some embodiments of the present disclosure.

Referring now to FIG. 9B, a bottom up view of a fan 910 with exemplary sport accessories 915 is illustrated. In some aspects, the sport accessories 915 may comprise customizable fan blades. In some embodiments, the sport accessories 915 may pair with the sport cover 920, such as relating to the same sport, team, or city, as non-limiting examples. For example, as illustrated, the sport cover 920 may comprise a baseball, and the sport accessories 915 may comprise baseball bats.

Figure 10A:
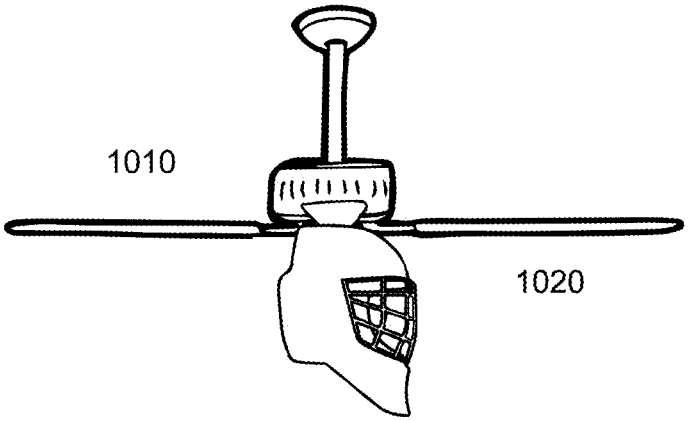
FIG. 10A illustrates a side view of a fan with an exemplary sport cover, according to some embodiments of the present disclosure.

Referring now to FIG. 10A, a side view of a fan 1010 with an exemplary sport cover 1020 is illustrated. In some embodiments, the sport cover 1020 may comprise a lacrosse helmet with a facemask. In some embodiments, the facemask may be detachable, which may allow for changing of a front panel, such as with different designs and colors.

Figure 10B:
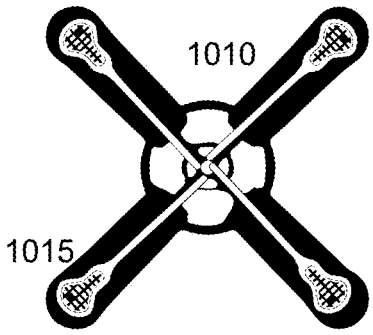
FIG. 10B illustrates a bottom up view of a fan with exemplary sport accessories, according to some embodiments of the present disclosure.

Referring now to FIG. 10B, a bottom up view of a fan 1010 with exemplary sport accessories 1015 is illustrated. In some aspects, the sport accessory may comprise fan blade skins that may be placed on the blades of the fan 1010. In some embodiments, installation of customized fan blades may not be practical or permitted, such as with a rental. In some implementations, fan blade skins may allow for easy customization, wherein the skins may be added and removed without damaging the fan blades. This may be beneficial where a user may want to periodically change the sport cover 1020 and sport accessories 1015. For example, the fan 1010 may be in a child's room whose interests may evolve as they grow. As another example, the fan 1010 may be in an entertainment room, where the sport cover 1020 and sport accessories 1015 may be switched between seasons, such as basketball season, baseball season, football season, or PGA Tour season, as non-limiting examples.

Figure 11:
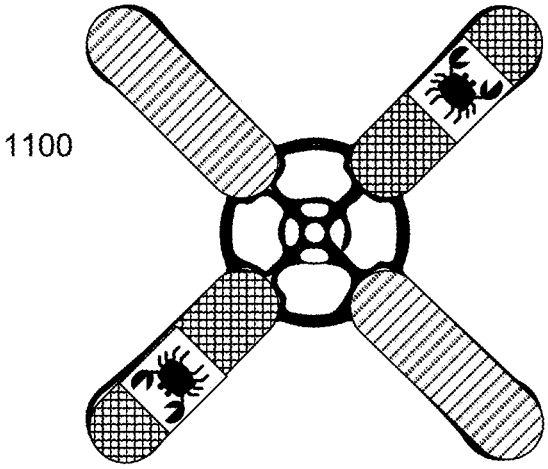
FIG. 11 illustrates a bottom up view of a fan with exemplary sport accessories, according to some embodiments of the present disclosure.

Referring now to FIG. 11, a bottom up view of a fan 1100 with exemplary sport accessories is illustrated. In some aspects, the sport accessories may comprise one or more fan blades and fan blade skins, wherein combinations may be customizable. In some implementations, custom fan blade colors may be selected and combined, such as to represent a particular sports team, and fan blade skins may comprise color details, team names, mascot images, sport images, player numbers, or player images, as non-limiting examples. As an illustrative example, four fan blades may comprise two team colors, and fan blade skins may comprise an image of the mascot.

Referring now to FIG. 12A, an exemplary pair of sport covers 1220, 1230 are illustrated. In some aspects, the pair of sport covers 1220, 1230 may comprise complementary types. As an illustrative example, a helmet sport cover 1220 may pair with a ball sport cover 1230 from the same sport, such as baseball, football, cricket, or lacrosse, as non-limiting examples.

Referring now to FIG. 12B, features 1210, 1240 with an exemplary pair of sport covers 1220, 1230 is illustrated. In some aspects, the sport covers 1220, 1230 may be split onto different features. A helmet sport cover 1220 may be used in wall mount lighting 1240, and a ball sport cover 1230 may be used with a fan 1210.

Referring now to FIG. 12C, an exemplary lamp 1250 with a pair of sport covers 1220, 1230 is illustrated. In some aspects, the sport covers 1220, 1230 may be used together to form a feature. In some embodiments, a ball sport cover 1230 may be used as a base of a lamp 1250 and a helmet sport cover 1220 may be used as the shade to soften the light source 1205. For example, the lamp 1250 may comprise a desk lamp, table side lamp, or night light. but is not limited to just those examples. In some implementations, a lamp 1250 or other portable feature may allow for the integration of sport covers 1220, 1230 in a wider range of locations than may a fixed feature, such as a fan or ceiling light. For example, a lamp 1250 may be placed in a garage, home, store, office, or patio.

Referring now to FIG. 12D illustrates a fan with an exemplary pair of sport covers, according to some embodiments of the present disclosure. In some embodiments, the sport covers 1220, 1230 may be used together on a single feature. In some aspects, a dual adapter 1260 may expand the fitting capabilities of a fan 1210 to allow for both sport covers 1220, 1230 to fit. In some implementations, the dual adapter 1260 may increase the lighting capabilities, such as increasing light sources for the fan 1210.

Referring now to FIG. 13, a fan 1310 with an exemplary sport cover 1320 and a portable device 1350 are illustrated. In some embodiments, the portable device 1350 may comprise a remote, which may control one or more attributes of one or both the fan 1310 and sport cover 1320. In some aspects, the portable device 1350 may utilize a removable battery, rechargeable power source, or both. In some implementations, the portable device 1350 may control a sport cover 1320 and its associated functions, such as a light source, fan 1310, sound source 1340, or panel colors, as non-limiting examples.

In some embodiments, the portable device 1350 may provide feedback, such as light, sound, or haptic, to indicate an action or status to a user. For example, status options may include on/off, low battery, or a need for a bulb change. As another example, action options may include color changes, sound changes, fan speed changes, on/off, timer changes, or control changes. In some aspects, the portable device 1350 may to control the activity of the fan 1310, the light source, a projector, a sound source 1340, or other cosmetic features that may be installed with the sport cover 1320. In some embodiments, where the sport cover 1320 may comprise a sound source 1340, the portable device 1350 may control volume levels and sound selection.

In some aspects, the portable device 1350 may comprise a personal smart device with a downloaded application that pairs with the sport cover 1320. In some embodiments, the personal smart device may allow for downloadable and streaming content, such as for sounds, images, or presets. For example, a user may be able to download songs. In some implementations, the available media content may be limited based on the sports. In some aspects, available media content may be based on subscriptions. In some embodiments, settings may be saved, which may allow a user to customize the settings for a particular occasion or event and then reuse those settings in the future without having to adjust each attribute.

For example, a user may subscribe to the sport cover channels associated with ESPN, the Jacksonville Jaguars, and the University of Connecticut. Each subscription may allow for the display of proprietary images and sounds during predefined times, such as during a game or during the draft. The images and sounds may include recordings of players, announcers, or coaches; logos; mascots; fight songs; or spirit songs, as non-limiting examples.

As an illustrative example, a user may be a fan of college football and may want to have lighting and sound to complement viewing the game at home. The portable device 1350 may select a game's presets, which may adopt custom settings to interact with the selected game. When a team scores, the light source may display the team colors, and the sound source 1340 may play the school's fight song. Where the sport cover 1350 may comprise a projector, images or short clips may be projected, such as a replay.

Figure 14:
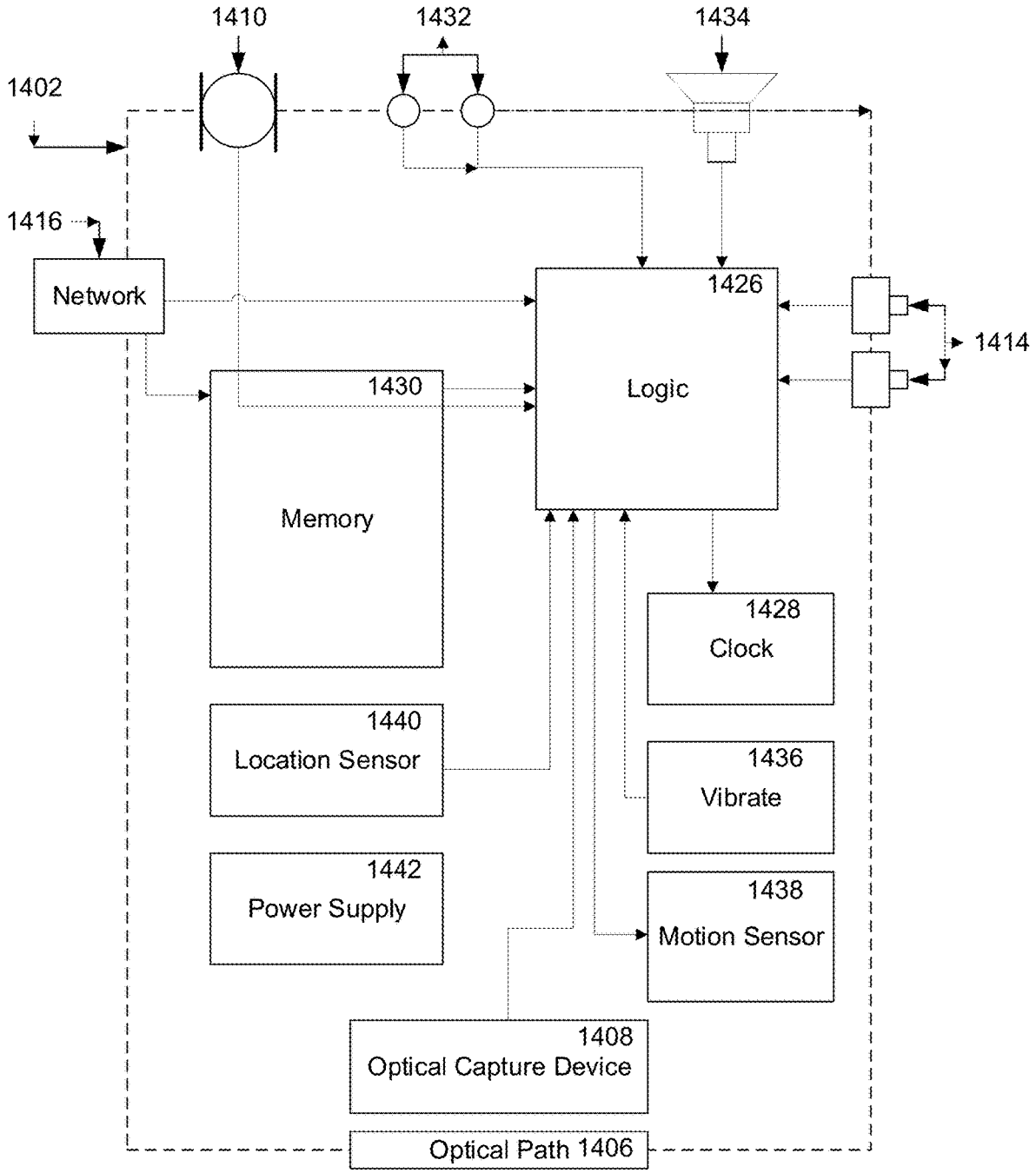
FIG. 14 illustrates an exemplary portable device that may be used with a sport cover, according to some embodiments of the present disclosure.

Referring now to FIG. 14, an exemplary block diagram of an exemplary embodiment of a mobile device 1402 is illustrated. The mobile device 1402 may comprise an optical capture device 1408, which may capture an image and convert it to machine-compatible data, and an optical path 1406, typically a lens, an aperture, or an image conduit to convey the image from the rendered document to the optical capture device 1408. The optical capture device 1408 may incorporate a Charge-Coupled Device (CCD), a Complementary Metal Oxide Semiconductor (CMOS) imaging device, or an optical sensor of another type.

In some embodiments, the mobile device 1402 may comprise a microphone 1410, wherein the microphone 1410 and associated circuitry may convert the sound of the environment, including spoken words, into machine-compatible signals. Input facilities 1414 may exist in the form of buttons, scroll-wheels, or other tactile sensors such as touchpads. In some embodiments, input facilities 1414 may include a touchscreen display. Visual feedback 1432 to the user may occur through a visual display, touchscreen display, or indicator lights. Audible feedback 1434 may be transmitted through a loudspeaker or other audio transducer. Tactile feedback may be provided through a vibration module 1436. 1005411*n* some aspects, the mobile device 1402 may comprise a motion sensor 1438, wherein the motion sensor 1438 and associated circuitry may convert the motion of the mobile device 1402 into machine-compatible signals. For example, the motion sensor 1438 may comprise an accelerometer, which may be used to sense measurable physical acceleration, orientation, vibration, and other movements. In some embodiments, the motion sensor 1438 may comprise a gyroscope or other device to sense different motions.

In some implementations, the mobile device 1402 may comprise a location sensor 1440, wherein the location sensor 1440 and associated circuitry may be used to determine the location of the device. The location sensor 1440 may detect Global Position System (GPS) radio signals from satellites or may also use assisted GPS where the mobile device may use a cellular network to decrease the time necessary to determine location. In some embodiments, the location sensor 1440 may use radio waves to determine the distance from known radio sources such as cellular towers to determine the location of the mobile device 1402. In some embodiments these radio signals may be used in addition to and/or in conjunction with GPS.

In some aspects, the mobile device 1402 may comprise a logic module 1426, which may place the components of the mobile device 1402 into electrical and logical communication. The electrical and logical communication may allow the components to interact. Accordingly, in some embodiments, the received signals from the components may be processed into different formats and/or interpretations to allow for the logical communication. The logic module 1426 may be operable to read and write data and program instructions stored in associated storage 1430, such as RAM, ROM, flash, or other suitable memory. In some aspects, the logic module 1426 may read a time signal from the clock unit 1428. In some embodiments, the mobile device 1402 may comprise an on-board power supply 1442. In some embodiments, the mobile device 1402 may be powered from a tethered connection to another device, such as a Universal Serial Bus (USB) connection.

In some implementations, the mobile device 1402 may comprise a network interface 1416, which may allow the mobile device 1402 to communicate and/or receive data to a network and/or an associated computing device. The network interface 1416 may provide two-way data communication. For example, the network interface 1416 may operate according to an internet protocol. As another example, the network interface 1416 may comprise a local area network (LAN) card, which may allow a data communication connection to a compatible LAN. As another example, the network interface 1416 may comprise a cellular antenna and associated circuitry, which may allow the mobile device to communicate over standard wireless data communication networks. In some implementations, the network interface 1416 may comprise a Universal Serial Bus (USB) to supply power or transmit data. In some embodiments, other wireless links known to those skilled in the art may also be implemented.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. An adaptable sport cover for a fixture with a light source, the adaptable sport cover comprising:

a sport equipment shell related to a first sport;

an opening adaptable to the fixture, wherein the opening receives a first portion of the fixture, wherein the first portion includes the light source;

an adapter, wherein the adapter removably connects the sport equipment shell to the first portion of the fixture, wherein the adaptable sport cover is removable to fit over a second fixture; and a sport sound source configured to play one or more sounds related to the first sport, wherein the sport sound source plays based on predefined times during a sport game related to the first sport.

2. The adaptable sport cover of claim 1, wherein the sport equipment shell comprises a helmet.

3. The adaptable sport cover of claim 1, wherein at lease one predefined time comprises a team scoring.

4. The adaptable sport cover of claim 1, wherein the portion of the fixture comprises a light source.

5. The adaptable sport cover of claim 4, wherein the adapter fits into an electrical connection of the fixture.

6. The adaptable sport cover of claim 5, wherein the adapter allows for remote control of the light source.

7. The adaptable sport cover of claim 4, wherein the sport equipment shell comprises a light-changing filter, where the light-changing filter affects a light type associated with the light source.

8. The adaptable sport cover of claim 7, wherein the light-changing filter is passive.

9. The adaptable sport cover of claim 7, wherein the light-changing filter is active.

10. The adaptable sport cover of claim 1, wherein the adapter is located at the opening.

11. The adaptable sport cover of claim 10, wherein the adapter comprises a spring mechanism.

12. The adaptable sport cover of claim 10, wherein the adapter is adjustable based on a size of the portion of the fixture.

13. An adaptable sport cover and fixture system comprising:

a fixture comprising alight source;

a plurality of sport covers, each of the plurality sport covers comprising:

a sport equipment shell related to a first sport;

an opening to accept the light source when each of the plurality of sport covers are fitted to the fixture, wherein the plurality of sport covers are interchangeable; and a sport sound source configured to play one or more sounds related to the first sport, wherein the sport sound source configured to play one or more sounds related to the first sport, wherein the sport sound source plays based on predefined times during a sport game related to the first sport.

14. The system of claim 13, wherein the fixture comprises a lamp.

15. The system of claim 13, wherein the sport cover comprises a helmet.

16. The system of claim 13, wherein the sport cover further comprises a sound source.

17. The system of claim 16, wherein control of one or more of the fixture, the light source, and the sound source is remote.

18. The system of claim 13, wherein the fixture comprises a ceiling fan.

19. The system of claim 13 wherein at least a portion of the one or more sounds comprises a fight song.

20. The system of claim 13, wherein at least a portion of one or more sounds, music, or dialogue comprises a replay of at least a portion of the sport game.

* * * * *